US005117993A

United States Patent [19]

Vesborg

[11] Patent Number: 5,117,993

[45] Date of Patent: Jun. 2, 1992

[54] CONTAINER HAVING SIDEWALLS SHAPED FOR SCREEN PRINTING

[75] Inventor: Steen Vesborg, Kraainem, Belgium

[73] Assignee: Colgate-Palmolive Company, Piscataway, N.J.

[21] Appl. No.: 647,698

[22] Filed: Dec. 26, 1990

Related U.S. Application Data

[63] Continuation of Ser. No. 328,754, Mar. 23, 1989, abandoned.

[30] Foreign Application Priority Data

Oct. 21, 1986 [DK] Denmark ..... 5055/86

[51] Int. Cl.[5] ..... B65D 1/02; B65D 1/40; B65D 25/38

[52] U.S. Cl. ..... 215/1 R; 215/365; 215/31

[58] Field of Search ..... 215/365, 1 C, 1 R, 31; D9/406, 405, 404, 413

[56] References Cited

U.S. PATENT DOCUMENTS

| | | | |
|---|---|---|---|
| D. 201,261 | 6/1965 | Roberts | D9/406 |
| D. 220,248 | 3/1971 | Blumenthal | D9/404 |
| D. 242,691 | 12/1976 | Koenigsberg | D9/406 X |
| D. 245,150 | 7/1977 | Koenigsberg | D9/404 |
| D. 263,026 | 2/1982 | Beechuk et al. | D9/404 |
| D. 268,897 | 5/1983 | Du Cret | D9/404 |
| D. 289,979 | 5/1987 | Crawford | D9/404 |
| D. 940,069 | 12/1934 | Brenner | D9/405 |
| 2,209,688 | 7/1940 | Davis | 215/1 R X |
| 2,951,440 | 9/1960 | Dubuit | 215/1 R X |
| 3,880,311 | 4/1975 | McPhee | 215/365 |
| 4,498,386 | 2/1985 | Rouly et al. | 101/40 |

FOREIGN PATENT DOCUMENTS

| | | | |
|---|---|---|---|
| 417486 | 2/1967 | Switzerland | 150/55 |
| 1074162 | 6/1967 | United Kingdom . | |

*Primary Examiner*—Sue A. Weaver
*Attorney, Agent, or Firm*—Michael J. McGreal; Murray M. Grill; Robert C. Sullivan

[57] ABSTRACT

A container (10) with printed information, and in particular a disposable plastic bottle, comprises a hyperboloidic surface (32, 34) or a hyperboloidic-like surface, on which information has been printed by means of a printing technique using line contact between the surface to be printed on and the print transferring element. A container is consequently obtained, which has an agreeable external appearance and is pleasant to handle, and simultaneously it is particularly suited for mass production.

5 Claims, 2 Drawing Sheets

CONTAINER HAVING SIDEWALLS SHAPED FOR SCREEN PRINTING

Figure 1:
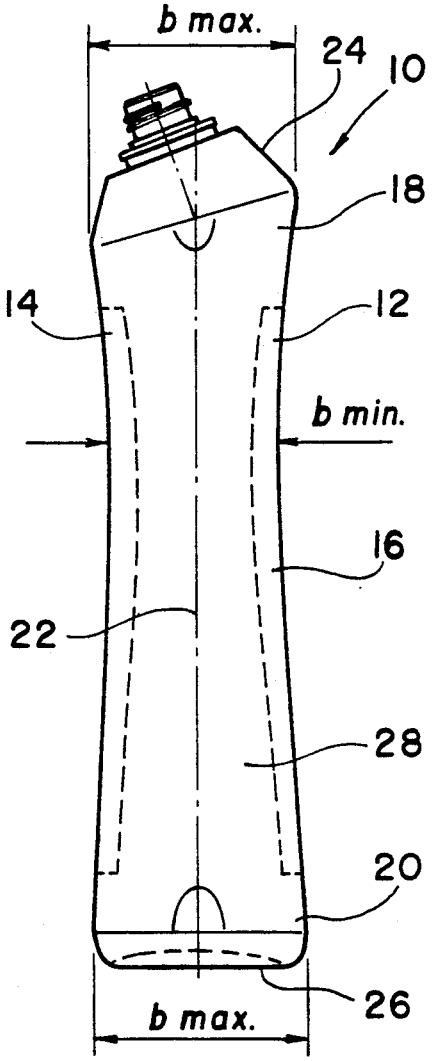

This application is a continuation of application Ser. No. 07/328,754 filed Mar. 23, 1989, now abandoned.

The present invention relates to a container with printed information and in particular to a disposable plastic bottle. The invention further relates to a method of manufacturing a container blanc and to a container blanc invented for manufacturing the container.

Various different containers are known of the type with information printed on a cylindrical, conical or plane surface in order to permit mass production of the container with printed information.

It is the object of the present invention to provide a container of the above type, which is suited for mass production, has an agreeable external appearance and is pleasant to handle.

In order to obtain this object the inventive container is characterized by comprising a hyperboloidic surface or a hyperboloidic-like surface, on which information has been printed by means of a printing technique using line contact between the surface to be printed on and the print transferring element. As a result a container is obtained with an agreeable external appearance, and which is pleasant to handle and simultaneously particularly suited for mass production.

The method of printing on a hyperboloidic surface or a hyperboloidic-like surface of a container blanc by means of a serigraphy-machine comprising a doctor blade, which in contact with a silk screen moves relative thereto, the side of said screen positioned opposite the doctor blade during said movement being in constant line contact with the surface of the container blanc to be printed on, the container blanc being moved synchronously with the doctor is characterized in that the doctor and consequently its line of contact with the screen are placed as generatrix for the hyperboloidic surface or the hyperboloidic-like surface to be printed on, whereafter the doctor and the screen are moved relative to each other and to the surface to be printed on in such a manner that the print producing part of the screen remains in line contact with said surface along a generatrix. This implies that it is possible very quickly and rationally to apply print to hyperboloidic surfaces or hyperboloidic-like surfaces with a rectilinear generatrix, whereby the degree of freedom with respect to the construction of the container is increased considerably.

The screen may according to the invention stand still while the doctor and the container blanc are moved synchronously in relation to each other. Consequently, the method becomes very simple and easily practicable.

An expedient plastic container blanc for manufacturing the container according to the invention, in particular a plastic bottle for liquid, powdered or pastelike cleaning materials or detergents, said container blanc comprising a closable opening, and where a horizontal section through the wall of the container blanc in its upright position describes a convex curve, preferably substantially an ellipse or a circle, is characterized in that at least portions of the wall of the container blanc describe one or several hyperboloidic surfaces or hyperboloidic-like surfaces. Such a container will, when containing an oxygen absorbing medium, not be visibly deformed when the medium absorbs the oxygen and partial vacuum arises inside the container. This is particularly due to the fact that a relative rotation, caused by the partial vacuum, between the upper and lower parts of the container blanc, round the longitudinal axis of the container blanc will not be visible provided part of the wall of the container blanc is a hyperboloidic surface and or a hyperboloidic-like surface. This is opposed to what would be the case if the wall of the container blanc was e.g. a cylindrical surface, which would dent if a partial vacuum should arise in the container blanc.

In a preferred embodiment of the container according to the invention the container has a substantially elliptic cross section, and the wall of the container blanc comprises two pairs of hyperboloidic surfaces mutually symmetrical about two mutually perpendicular symmetry planes. A container blanc is consequently obtained with an agreeable external appearance and which is pleasant and easy to handle.

Figure 2:
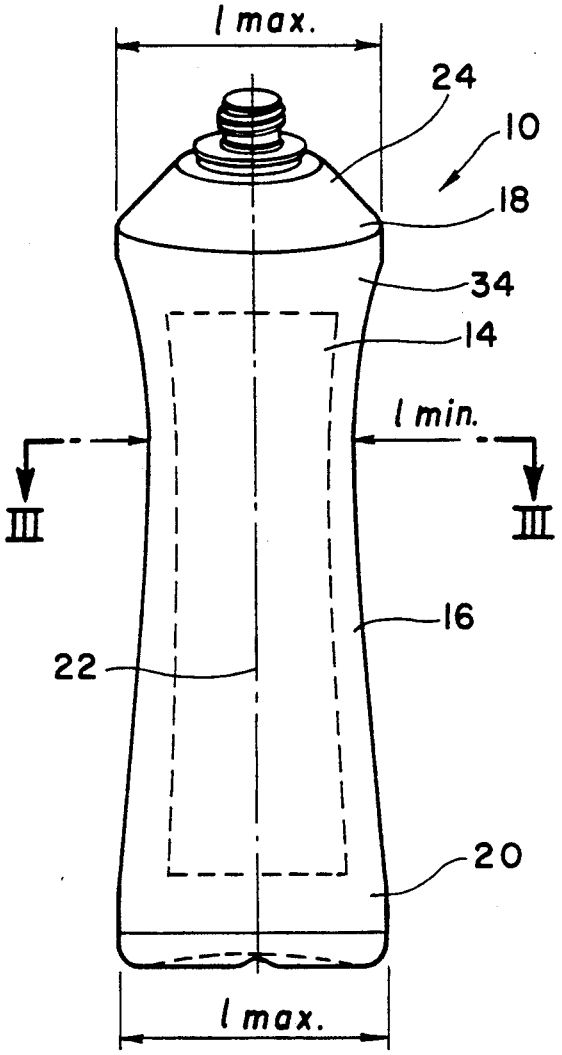
Figure 3:
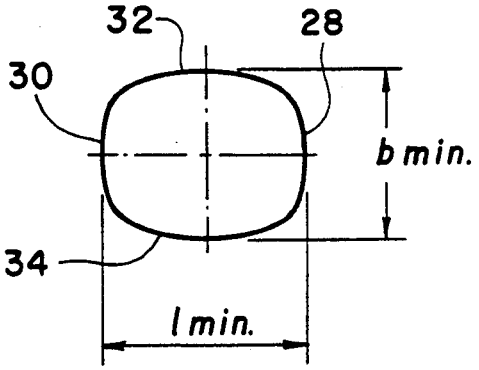
Figure 4:
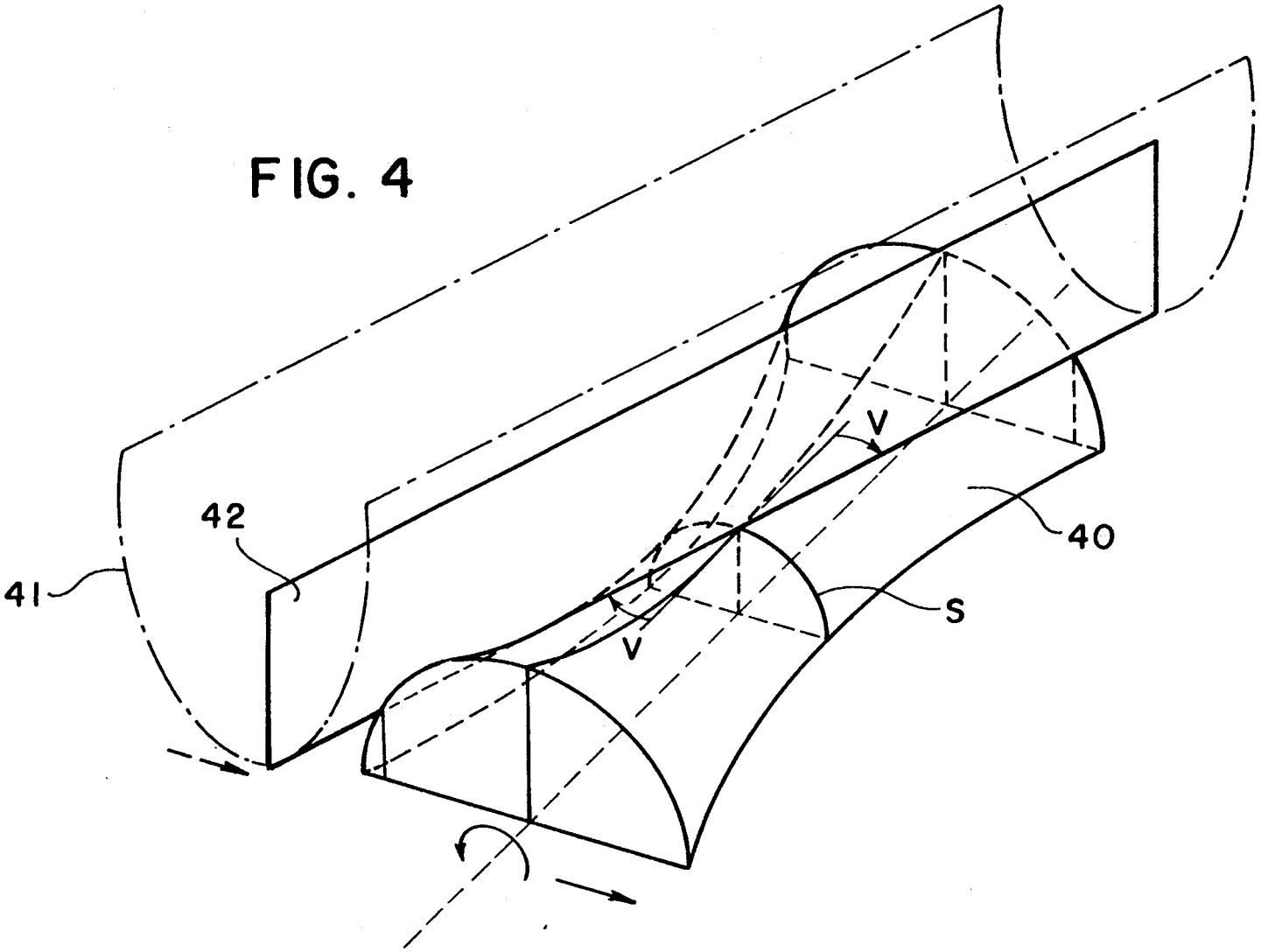

The invention will be described more detailed below with reference to the accompanying drawing, in which FIG. 1 is a side view of a container according to the invention with printed information, FIG. 2 is a front view of the container of FIG. 1, FIG. 3 illustrates the cross-section geometry of the container along the line III—III of FIG. 2, and FIG. 4 is a schematic view of a method according to the invention for applying print to a hyperboloidic surface.

FIGS. 1 and 2 are a side view and a front view, respectively, of a preferred embodiment of a container 10 according to the invention with printed information. The areas 12, 14, of the container 10, on which information has been printed, is illustrated by dotted lines. The container 10 comprises a body 16 which at the top passes into a shoulder 18 and at the bottom into a base 20. The shoulder 18 is substantially conical, is tilted in relation to the longitudinal axis 22 of the container and passes at the top into a neck 24 provided with a closable opening. The base 20 extends from the body 16 in a slightly conical downward direction to form the support surface 26 of the container 10.

As shown in FIG. 3 the body 16 has a substantially elliptic cross-section and consists of two pairs of hyperboloidic surfaces 28, 30, and 32, 34, respectively, which are mutually symmetric about two mutually perpendicular symmetry planes. The areas 12, 14 with printed information form part of the hyperboloidic surfaces 32, 34. As it appears from FIGS. 1 and 2 the greatest dimensions $l_{max}$, $b_{max}$ of the container along the two symmetry planes of the body 16 are the same at the shoulder 18 and at the base 20, and the body 16 has its smallest dimensions $l_{min}$, $b_{min}$ at the waist-curve s, cf. FIG. 3, for the two pairs of symmetrical hyperboloidic surfaces 28, 30 and 32, 34, respectively. This implies that the containers will stand steadily and stably when packed in e.g. a cardboard box.

The container blanc may be manufactured by blow moulding and is particularly suited for stretch blow moulding.

The container blanc is preferably made of plastic material, e.g. of the type polyethylene (PE), polypropylene (PP), polyethylene terephthalate (PET), polyethylene terephthalate glycol (PETG), polyvinyl chloride (PVC), acrylonitrile (AN) and copolymers thereof. The said materials may also contain a reinforcing material such as fibre glass. As a result of the use of hyperboloidic surfaces 28, 30; 32, 34 for the formation of the body 16 there is no visible deformation of the container blanc 10, when partial vacuum arises therein. Partial vacuum occurs in container blancs, when said container blancs contain an oxygen absorbing medium, e.g. a medium containing aldehydes or unsaturated fatty acids, and the container blanc during filling is not filled completely, as the medium will then after some time absorb the oxygen. Due to the partial vacuum formed, the upper part of the container blanc (here the shoulder 18) will rotate in relation to the lower part of the container blanc (here the base 20), and as a result there will be a dent on the body (here 16), if the container does not—as in the present invention—consist of hyperboloidic surfaces 28, 30, and 32, 34, respectively, or hyperboloidic-like surfaces.

The inventive method for applying print, preferably serigraphy, to a hyperboloidic surface or a hyperboloidic-like surface of a container blanc is schematically illustrated in FIG. 4. The Figure illustrates a hyperboloidic surface 40, to which serigraphy should be applied. In serigraphy a doctor blade 42 is applied, which in contact with a planar, flexible silk screen 41 (illustrated with a dot-and-dash line) moves relative to the silk screen 41 and thus presses ink through the masks of the silk screen 41 and onto the surface to be printed on, i.e. in the present case the hyperboloidic surface 40, said surface moving synchronously in relation to the movement of the doctor in such a manner that there is constant line contact between the surface to the printed on and the silk screen 41, and between the silk screen 41 and the doctor 42, respectively. In the method according to the invention the doctor 42 and consequently its line of contact with the silk screen 41 are placed as generatrix for the hyperboloidic surface 40 to be printed on, whereafter the doctor 42 moves rectilinearly across the silk screen 41, which stands still, and simultaneously the hyperboloidic surface is partly rotated and partly moved translatively synchronously with the movement of the doctor 42, so that the print causing part of the silk screen 41 remains in line contact with the said surface along a generatrix to the hyperboloidic surface 40.

It is thus possible by means of the method according to the invention to apply print to an arbitrarily formed surface which can be formed by propagating a rectilinear generatrix along any planoconvex directrix the generatrix generally not being surface normal compared to the plane of the directrix. The hyperboloide is a special example thereof, as the curved guide is here an ellipse or in connection with an rotary hyperboloide a circle.

I claim:

1. A container which has walls that are of a shape suitable for direct screen printing thereon and wherein when said containers are in contact said walls and the printing thereon are not in contact to thereby preserve the printing thereon comprising a base and a shoulder which are spaced apart and each of the edges of which form the outermost dimensions of said container and are the contact points with other like containers, said base and shoulder interconnected by walls, each wall having a hyperboloidal surface extending substantially from said base to said shoulder wherein planes passing through the longitudinal axis of said container define a hyperbola at the intersection of said planes through the longitudinal axis and said walls, and planes through said container at acute angles to and intersecting the longitudinal axis thereof form a series of straight lines at the intersection of said planes at acute angles and said walls.

2. A container according to claim 1, wherein said container is of an elliptic cross section.

3. A container which has walls that are of a shape suitable for direct screen printing thereon and wherein when said containers are in contact said walls and the printing thereon are not in contact to thereby preserve the printing comprising a base and a shoulder which are spaced apart and each of the edges of which form the outermost dimensions of said container and are the contact points with other like containers, said base and shoulder interconnected by walls, each wall having a hyperboloidal surface extending substantially from said base to said shoulder wherein planes passing through the longitudinal axis of said container define a hyperbola at the intersection of said planes through the longitudinal axis and said walls, and planes through the longitudinal axis and planes through said container at acute angles to and intersecting the longitudinal axis thereof form a series of straight lines at the intersection of said planes at acute angles and said walls, and a spout disposed above said shoulder.

4. A container according to claim 3, wherein said spout is disposed at an angle from the longitudinal axis of said container.

5. A container according to claim 3 wherein said container is of an elliptic cross section.

* * * * *